US007093332B1

(12) United States Patent
Kay

(10) Patent No.: US 7,093,332 B1
(45) Date of Patent: Aug. 22, 2006

(54) LOCKING TOGGLE ASSEMBLY FOR JEWELRY

(76) Inventor: Scott Kay, 565 S. Mountain Rd., New City, NY (US) 10956

( * ) Notice: Subject to any disclaimer, the term of this patent is extended or adjusted under 35 U.S.C. 154(b) by 0 days.

(21) Appl. No.: 10/697,607

(22) Filed: Oct. 29, 2003

(51) Int. Cl.
*A44B 11/24* (2006.01)
*A44C 5/00* (2006.01)

(52) U.S. Cl. ..... 24/647; 24/684; 63/3.1; 63/4

(58) Field of Classification Search ..... 24/3.13, 24/116 R, 72.7, 609, 684, 700, 643, 644, 24/646, 647, 650; 63/3.1, 4
See application file for complete search history.

(56) References Cited

U.S. PATENT DOCUMENTS

| | | | | | |
|---|---|---|---|---|---|
| 906,616 | A | * | 12/1908 | Cox | 24/684 |
| 1,107,126 | A | * | 8/1914 | Wilson | 24/377 |
| 1,134,994 | A | * | 4/1915 | Conkey | 24/116 A |
| 1,401,503 | A | * | 12/1921 | Smith | 24/116 R |
| 1,718,908 | A | * | 6/1929 | Kleffman | 24/116 R |
| 1,794,384 | A | * | 3/1931 | Madsen | 24/647 |
| 4,055,057 | A | | 10/1977 | Kolman | |
| 4,245,377 | A | | 1/1981 | Soltes | |
| 4,763,490 | A | | 8/1988 | Bruner | |
| 5,410,784 | A | * | 5/1995 | Katz | 24/587.1 |
| 5,826,309 | A | | 10/1998 | Tsamas | |
| 6,036,065 | A | | 3/2000 | Wofford et al. | |
| 6,041,479 | A | | 3/2000 | Colpo | |
| 6,349,453 | B1 | | 2/2002 | Nicoletti et al. | |
| 6,422,036 | B1 | | 7/2002 | Giannis et al. | |
| 6,438,995 | B1 | | 8/2002 | Kuptzin et al. | |
| 6,484,376 | B1 | | 11/2002 | Khatchadourian et al. | |
| D474,423 | S | | 5/2003 | James | |
| 2004/0139586 | A1 | * | 7/2004 | Fox | 24/701 |

* cited by examiner

*Primary Examiner*—James R. Brittain
(74) *Attorney, Agent, or Firm*—Kenneth S. Weitzman; Chadbourne & Parke LLP

(57) ABSTRACT

A locking toggle clasp assembly for releasably coupling opposing terminal portions of a jewelry item, includes a toggle bar connected to a first terminal portion of the jewelry item. A toggle clasp having an opening is connected to a second terminal portion of the jewelry item. The toggle clasp is selectively movable between an open position in which the toggle bar may pass through the opening and a locked position in which the toggle bar is prevented from passing through the opening.

19 Claims, 2 Drawing Sheets

LOCKING TOGGLE ASSEMBLY FOR JEWELRY

BACKGROUND OF THE INVENTION

1. Field of the Invention

The present invention relates generally to clasps for coupling ends of an article of jewelry together and, more particularly, to a locking toggle clasp assembly for selectively connecting the terminal ends of a chain or link bracelet, necklace or the like.

2. Description of the Related Art

Jewelry items are commonly draped or fastened about the wrist, neck or other appendage of a person to accessorize that person's appearance. Bracelets and necklaces are examples of such jewelry items. Various fastening mechanisms have been utilized to secure the jewelry item to the person wearing it.

Conventional chain or link bracelets and necklaces typically have a "closed loop" structure that can be opened to permit the bracelet or necklace to be draped about the wrist, neck or other appendage of the person wearing it. There are many types of conventional spring-operated clasps for securing the ends of chain or link bracelets and necklaces. The most widely known and used clasp is a spring ring connected to one end of the bracelet or necklace and a jump ring connected to the opposing end. The spring ring typically includes a C-shaped tubular housing containing a movable arcuate insert. The insert is normally biased by a spring to close the spring ring (i.e., to close the opening or gap in the C-shaped housing) and is selectively movable to an open position so that the jump ring on the opposing end of the jewelry item may be selectively connected to or disconnected from the spring ring.

Other conventional bracelets or necklaces include pivotally connected sections that lock together to form a closed loop configuration. A male section typically has a protruding member while a female section has a recess for receiving the protruding member. The protruding member is cooperatively positioned within the recess to lock the bracelet or necklace in the closed position.

It is desirable to provide an improved jewelry clasp assembly over conventional jewelry clasps that offers, at least, the following attributes: (1) ease of manipulation by the person wearing the jewelry item; (2) secure, positive closure; (3) compactness of size; (4) aesthetic appearance; (5) strength and reliability; (6) simplicity of construction; (7) economy of manufacture; (8) ease of assembly; (9) absence of sharp or jagged edges; and (10) application to a wide spectrum of jewelry.

SUMMARY OF THE INVENTION

A locking toggle clasp assembly is provided for releasably coupling opposing terminal portions of a jewelry item. The locking toggle clasp assembly includes a toggle bar connected to a first terminal portion of the jewelry item. A toggle clasp having an opening is connected to a second terminal portion of the jewelry item. The toggle clasp is selectively movable between an open position in which the toggle bar may pass through the opening and a locked position in which the toggle bar is prevented from passing through the opening.

The foregoing specific objects and advantages of the invention are illustrative of those that can be achieved by the present invention and are not intended to be exhaustive or limiting of the possible advantages which can be realized.

Thus, these and other objects and advantages of this invention will be apparent from the description herein or can be learned from practicing this invention, both as embodied herein or as modified in view of any variations which may be apparent to those skilled in the art. Accordingly, the present invention resides in the novel parts, constructions, arrangements, combinations and improvements herein shown and described.

BRIEF DESCRIPTION OF THE DRAWINGS

Further aspects of the instant invention will be more readily appreciated upon review of the detailed description of the embodiments included below when taken in conjunction with the accompanying drawings, of which.

DETAILED DESCRIPTION OF THE INVENTION

Referring to FIGS. 1–4, wherein similar components of the invention are numerically referenced in like manner, there is shown a preferred embodiment of a toggle clasp assembly 1 on an exemplary jewelry item 10. It is understood that the toggle clasp assembly 1 can be utilized on a wide variety of jewelry, including, but not limited to, chain or link bracelets, necklaces and the like, and that there is no intention to limit the invention to a single type of jewelry. In addition, the jewelry items on which the toggle clasp assembly 1 can be used may be any one of the variety of ornamental designs and may include precious metals or jewels, such as gold, platinum, sterling silver and/or diamonds.

Figure 1:
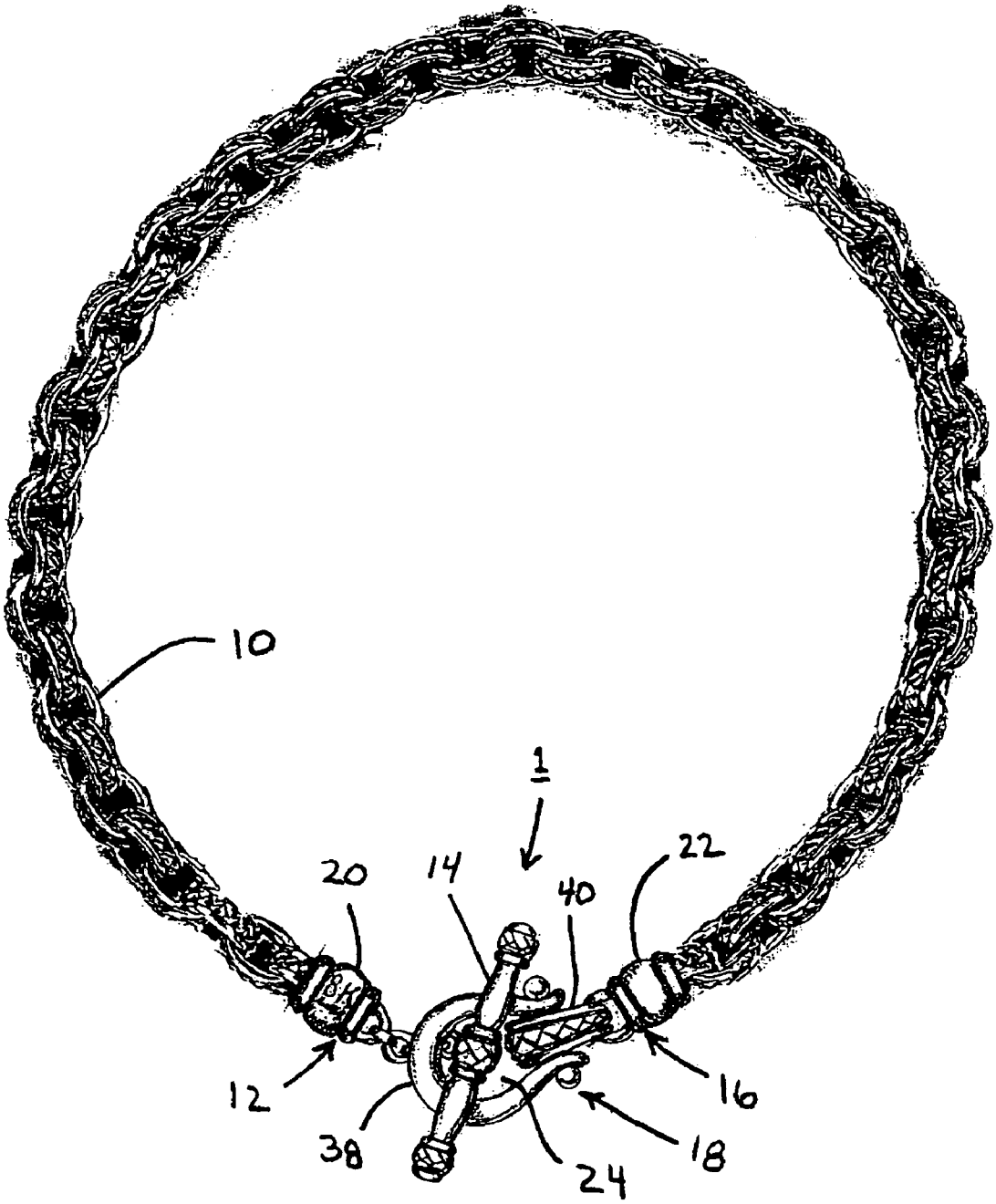
FIG. 1 is a top plan view of a toggle clasp assembly in accordance with a preferred embodiment employed on an exemplary jewelry item and showing the ends of the jewelry item secured to one another in a locked configuration.

FIG. 1 illustrates the preferred toggle clasp assembly 1 employed on an exemplary jewelry item 10 (e.g., a chain or link bracelet, necklace or the like) to secure the terminal portions or ends 12, 16 of the jewelry item to one another in a locked or closed configuration. The toggle clasp assembly 1 employs a toggle bar or post 14 and a locking toggle clasp 18 to selectively secure the opposing ends 12, 16 of the jewelry item 10 to one another in a locked or closed loop configuration.

The toggle bar 14 is provided at a first terminal portion or end 12 of the jewelry item 10. When in the closed or locked position, the toggle bar 14 extends generally in a plane perpendicular to the central axis of the jewelry item 10. The locking toggle clasp 18 is provided at a second terminal portion or end 16 of the jewelry item 10. The toggle bar 14 and locking toggle clasp 18 may be attached to the opposing terminal portions or ends 12, 16 of the jewelry item 10 in any known conventional manner.

As will be discussed in greater detail below, the locking toggle clasp 18 is selectively moveable between an open position (depicted in FIGS. 3 & 4) and a closed or locked position (depicted in FIGS. 1 & 2). To secure the opposing terminal portions or ends 12, 16 of the jewelry item 10 to one another in the locked position, the toggle bar 14 is passed through an opening 24 within the locking toggle clasp 18 when the toggle clasp is in the open position, and the toggle clasp 18 is then moved to the closed or locked position. When the toggle clasp 18 is in the closed or locked position, the a portion of the toggle clasp 18 impinges into the opening 24 to prevent the toggle bar 14 from passing through it, thereby securing the opposing terminal portions or ends 12, 16 to one another.

Thus, if the jewelry item 10 is draped around an appendage of the person wearing it, the toggle bar 14 is passed through the opening 24 of the toggle clasp 18, the toggle clasp 18 is then moved to its closed or locked position, and the jewelry item 10 is conveniently secured or locked around the appendage of the person wearing it. Similarly, to remove or unlock the jewelry item 10, the toggle clasp 18 is moved to its open position and the toggle bar 14 may be passed through the opening 24.

Figure 2:
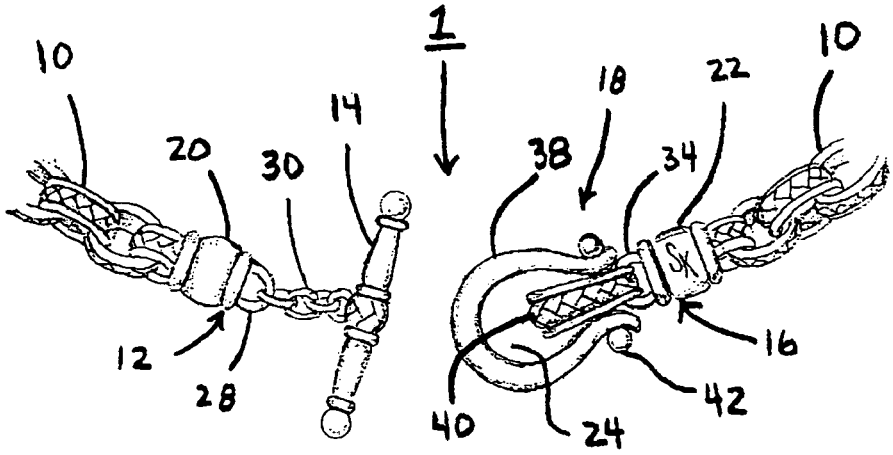
FIG. 2 is a partial top plan view of the toggle clasp assembly of FIG. 1 showing the toggle clasp in a closed position without the ends of the jewelry item secured to one another.

FIG. 2 illustrates the toggle clasp assembly 1 with the toggle clasp 18 in the closed or locked position, but without the two opposed terminal portions or ends 12, 16 of the jewelry item 10 joined or locked together. As indicated above, the toggle bar 14 is attached to the first terminal portion or end 12 of the jewelry item 10 in a conventional manner. For instance, in a preferred embodiment, the toggle bar 14 is preferably attached to a link or loop 28 at or near the first terminal portion or end 12 by means of a relatively short chain or small group of links 30. The links or chain 30 provide additional flexibility for ease of manipulation of the toggle bar 14 through opening 24 in the locking toggle clasp 18. If desired, a decorative first end cap 20 having the link 28 may be provided at the first terminal portion or end 12 of the jewelry item 10.

Similarly, the toggle clasp 18 is attached to the second terminal portion or end 16 of the jewelry item 10 in a conventional manner. For instance, in a preferred embodiment, the locking toggle clasp 18 is preferably attached to a link or loop 34 at or near the second terminal portion or end of the jewelry item 10. If desired, a decorative second end cap 22 having the link 34 may be provided at the second terminal portion or end 16 of the jewelry item 10. Other well known means may be used to connect the toggle bar 14 and toggle clasp 18 to the opposing ends of the jewelry item 10.

In the preferred embodiment, the locking toggle clasp 18 includes a toggle loop 38 and a swivel 40 pivotally connected to the loop by means of a pin 42. The toggle loop 38 defines an opening 24. The swivel 40 is selectively moveable between an open position and a closed or locked position. In the closed or locked position, the swivel 40 impinges into and blocks a portion of the opening 24 in the toggle loop 38 such that the toggle bar 14 is not able to pass though the opening 24. The swivel 40 is held in the closed or locked position by friction created between contact surfaces on the swivel 40 and the toggle loop 38.

In a preferred embodiment, the toggle bar 14 is larger than the opening 24 of the toggle loop 38 in a first dimension (major dimension) along a first axis and smaller than the opening 24 of the toggle loop 38 in a second dimension (minor dimension) along a second axis. In this manner, the toggle bar 14 is able to pass through the opening 24 in the toggle loop 38 when the swivel 40 is in the open position, but is prevented from passing through the opening 24 in the toggle loop 38 when the swivel 40 is in the closed position.

Figure 3:
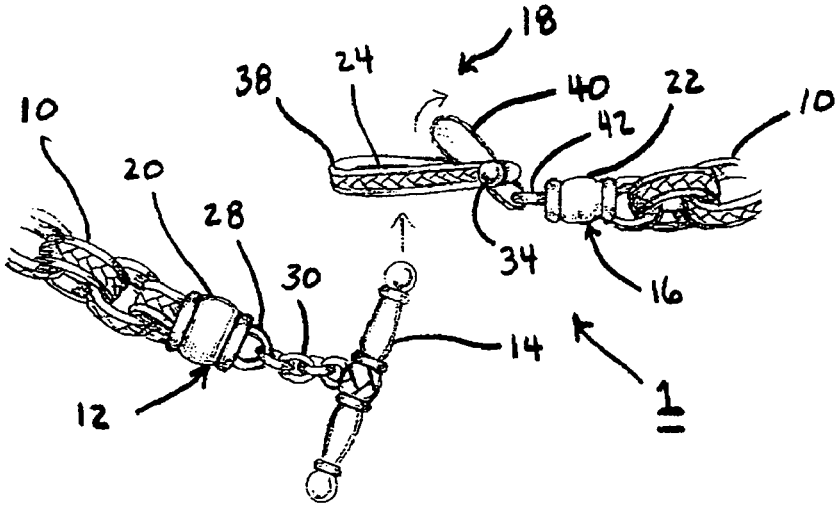
FIG. 3 is a partial side elevation view of the toggle clasp assembly of FIG. 1 showing the toggle clasp in an open position with the ends of the jewelry item in the process of being secured to one another.
Figure 4:
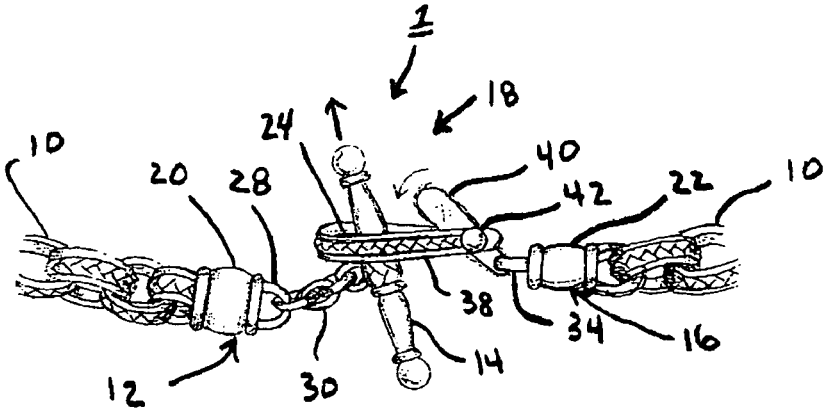
FIG. 4 is a partial side elevation view of the toggle clasp assembly of FIG. 1 showing the toggle clasp in an open position with the ends of the jewelry item in the process of being secured to one another.

FIGS. 3 & 4 illustrate the toggle clasp assembly 1 with the toggle clasp 18 in the open position and the ends 12, 16 of the exemplary jewelry item 10 in the process of being secured to one another. Referring to FIG. 3, the toggle clasp 18 is manually moved to the open position by pivoting the swivel 40 relative the toggle loop 38 against the force of friction between contact surfaces of the loop and swivel. In the open position, the opening 24 in the toggle loop 38 is unobstructed by the swivel 40 and, hence, is larger than the open area cooperatively defined when the swivel 40 is in the closed or locked position. When the swivel 40 is manually moved to the closed or locked position, the swivel impinges into the opening 24 in the toggle loop 38 to prevent the toggle bar 14 from passing through the opening 24.

Since the toggle bar 14 is smaller than the opening 24 in the second (minor) dimension, the toggle bar 14 may be inserted through the opening 24 along the axis corresponding to the second dimension when the swivel 40 is in its open position (i.e., not impinging into the opening 24). When the swivel 40 is pivoted to its closed position, however, the swivel impinges into and blocks a portion of the opening 24 in the toggle loop 38 to prevent the toggle bar 14 from passing through the opening 24. The swivel 40 is releasably held in the closed or locked position by frictional engagement between contact surfaces of the toggle bar 14 and swivel 40. The toggle bar 14 cannot pass through the opening 24 because the toggle bar is larger than the opening 24 in at least the first (major) dimension and the opening 24 is not large enough to permit the toggle bar 14 to pass through it along the axis corresponding to the second (minor) dimension when the swivel 40 is in its closed or locked position.

Although an illustrative preferred embodiment has been described herein in detail, it should be noted and will be appreciated by those skilled in the art that numerous variations may be made within the scope of this invention without departing from the principle of this invention and without sacrificing its chief advantages. For example, it is understood that the opening 24 and toggle loop 38 need not be curved or round, and that other shapes can be utilized in accordance with and within the scope of this invention. The terms and expressions have been used herein as terms of description and not terms of limitation. There is no intention to use the terms or expressions to exclude any equivalents of features shown and described or portions thereof and this invention should be defined in accordance with the claims that follow.

I claim:

1. A locking toggle clasp assembly for releasably coupling opposing terminal portions of a jewelry item, comprising:

a toggle bar connected to a first terminal portion of the jewelry item; and a toggle clasp connected to a second terminal portion of the jewelry item, the toggle clasp having a loop with proximal and distal portions, defining an opening, the distal portion of the loop being farthest from the second terminal portion of the jewelry item, and a swivel, with proximal and distal portions, the distal portion of the swivel being farthest from the second terminal portion of the jewelry item;

the swivel is selectively movable between an open position in which the swivel is substantially outside of the opening, and a locked position, in the locked position the distal end of the swivel is inside the opening, and a gap exists in the portion of the opening not filled by the swivel, wherein a portion of the jewelry item attached to the toggle passes through the gap and between the distal portion of the swivel and the distal portion of the loop.

2. The locking toggle clasp assembly according to claim 1, wherein the toggle bar has a major axis and a minor axis, the toggle bar being larger than the opening in a first dimension along the major axis and smaller than the opening in a second dimension along the minor axis when the toggle clasp is in the open position.

3. The locking toggle clasp assembly according to claim 2, wherein the toggle bar is adapted to be inserted through the opening along the minor axis when the toggle clasp is in the open position.

4. The locking toggle clasp assembly according to claim 3, wherein the major axis of the toggle bar is in a plane generally perpendicular to a major axis of the jewelry item.

5. The locking toggle clasp assembly according to claim 1, wherein the loop and the swivel cooperatively define a first open area when the swivel is in the open position and a second open area when the swivel is in the locked position, the second open area being smaller than the first open area.

6. The locking toggle clasp assembly according to claim 1, wherein the swivel is releasably maintained in the locked position due to frictional engagement between the swivel and the loop.

7. The locking toggle clasp assembly according to claim 1, further comprising means for connecting the toggle bar to the first terminal portion of the jewelry item.

8. The locking toggle clasp assembly according to claim 1, further comprising means for connecting the toggle clasp to the second terminal portion of the jewelry item.

9. The locking toggle clasp assembly according to claim 1, wherein the jewelry item is a chain.

10. The locking toggle clasp assembly according to claim 1, wherein the jewelry item is a bracelet.

11. The locking toggle clasp assembly according to claim 10, wherein the bracelet comprises a plurality of links.

12. The locking toggle clasp assembly according to claim 1, wherein the jewelry item is a necklace.

13. The locking toggle clasp assembly according to claim 12, wherein the necklace comprises a plurality of links.

14. A toggle clasp assembly for releasably coupling opposing ends of an item of jewelry, comprising:

a male toggle member having a major dimension along a first axis and a minor dimension along a second axis, the male toggle member adapted to be coupled to a first end of the jewelry item such that the first axis is generally perpendicular to a major axis of the jewelry item;

a female toggle member defining an opening and adapted to be coupled to an opposing end of the jewelry item, the female toggle member having a portion distal to the opposing end of the jewelry item; and a protruding member pivotally connected to the female toggle member and having an end distal to the opposing end of the jewelry item, the protruding member being selectively movable between an open position in which the protruding member is substantially outside the opening allowing the male toggle member to pass through the opening, and a closed position in which the distal end of the protruding member is inside the opening to reduce the size of the opening to prevent the male toggle member from passing through the opening and a portion of the first end of the jewelry item passes through the opening between the distal end of the protruding member and the distal portion of the female toggle member.

15. The toggle clasp assembly according to claim 14, wherein the major dimension of the male toggle member is larger than the opening.

16. The toggle clasp assembly according to claim 15, wherein the male toggle member can pass through the opening along the second axis corresponding to the minor dimension when the protruding member is in the open position.

17. The toggle clasp assembly according to claim 15, wherein the protruding member is releasably maintained in the closed position due to frictional engagement between the protruding member and the female toggle member when the protruding member is in the closed position.

18. A method for releasably coupling opposed ends of an item of jewelry, comprising:

providing a male toggle member on a first end of the item of jewelry, the male member having a major dimension and a minor dimension;

providing a female toggle member on an opposing end of the item of jewelry, the female toggle member defining an opening that is smaller than the major dimension, the female toggle member having a portion distal to the opposing end of the item of jewelry;

pivoting a swivel about the female toggle member to an open position in which the swivel is substantially outside the opening;

inserting the male toggle member through the opening along an axis corresponding to the minor dimension when the swivel is in the open position;

pivoting the swivel to a closed position in which an end of the swivel distal to the opposing end of the item of jewelry is within the opening and a portion of the item of jewelry extends through the opening between the distal end of the swivel and the distal portion of the female toggle member, wherein the swivel reduces the opening to a second size to prevent the male toggle member from passing through the opening.

19. The method according to claim 18, further comprising releasably locking the swivel in the closed position by frictional engagement between the swivel and the female toggle member.

* * * * *